United States Patent [19]

Denison

[11] Patent Number: 4,576,516

[45] Date of Patent: Mar. 18, 1986

[54] RISER ANGLE CONTROL APPARATUS AND METHOD

[75] Inventor: Early B. Denison, Houston, Tex.

[73] Assignee: Shell Oil Company, Houston, Tex.

[21] Appl. No.: 675,668

[22] Filed: Nov. 28, 1984

[51] Int. Cl.[4] ..... E21B 7/12

[52] U.S. Cl. ..... 405/195; 166/367; 175/7; 405/202

[58] Field of Search ..... 405/195, 202, 224; 114/264; 166/350, 359, 367; 175/5, 7, 9

[56] References Cited

U.S. PATENT DOCUMENTS 3,359,741 12/1967 Nelson ..... 166/350 X 3,522,709 8/1970 Vilain ..... 405/202

3,523,578 8/1970 Nolan et al. ..... 166/359

4,067,202 1/1978 Reed ..... 405/195

*Primary Examiner*—David H. Corbin

[57] ABSTRACT

Method and apparatus for use in drilling a well from an offshore drilling vessel having a riser extending from the vessel down to a subsea wellhead. The apparatus of the invention comprises a flexible coupling installed in the riser's upper elements, with a tensioned cable connected between the flexible coupling and the vessel. The angle of misalignment of the riser's upper elements due to ocean currents impacting the riser and/or vessel may be maintained within acceptable limits by adjusting the tension applied to the flexible coupling.

8 Claims, 1 Drawing Figure

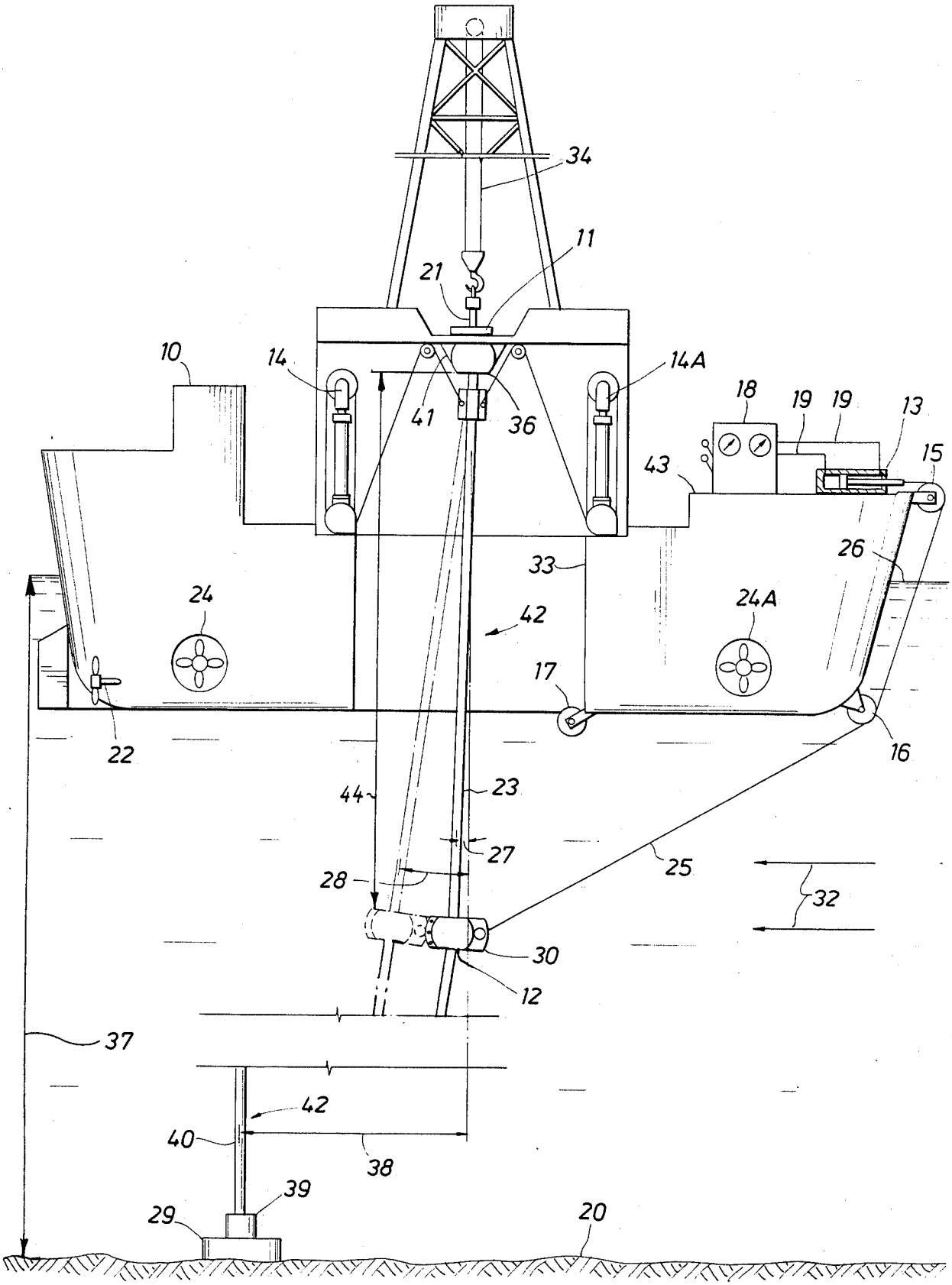
34
11
21
10
14
14A
41
36
18
19
19
13
15
43
26
33
24
42
24A
17
22
16
44
23
27
25
28
32
30
12
37
42
40
38
39
29
20

RISER ANGLE CONTROL APPARATUS AND METHOD

BACKGROUND OF THE INVENTION

1. Field of the Invention

The invention relates to a method and apparatus for use in drilling a well from an offshore floating vessel, the vessel having a marine riser interconnected between the vessel and a subsea wellhead assembly.

2. Description of the Prior Art

An increasing amount of offshore deepwater exploratory well drilling is being conducted in an attempt to locate oil and gas reservoirs. These exploratory wells are generally drilled from floating vessels. As in any rotary drilling operation, drilling fluid must be circulated through the drill bit in order to cool the bit and to carry away the cuttings. This drilling fluid is normally returned to the floating vessel by means of a large diameter pipe, known as a riser, which extends between a subsea wellhead assembly and the floating vessel. The lower end of this riser is connected to the wellhead assembly which is generally adjacent the ocean floor, and the upper end usually extends through a centrally located hull opening of the floating vessel. A drillstring extends downward through the riser into earth formations lying below the body of water, and drilling fluids circulate downwardly through the drillstring, out through the drilling bit, and then upwardly through the annular space between the drillstring and riser, returning to the vessel.

As the water depths for these drilling operations continue to increase, the length of the riser and subsequently its unsupported weight also increases. The riser has the same structural buckling characteristics as a vertical column, such that riser structural failure may result if compressive stresses occur over a long length of the riser. To avoid the possibility of this occurrence, riser tensioning systems are installed on board the vessel, which apply an upward force to the upper end of the riser, usually by means of cable and sheave mechanisms connected between the vessel and the upper elements of the riser.

Since the drillstring rotates as it extends downward through the riser, any inclination of the riser away from a vertical plane defined from the drilling equipment located on the vessel to the wellhead assembly will cause the drillstring to contact the interior surface of the riser. Continuous drillstring rotation will cause chafing at the points of drillstring and riser contact. Any unnecessary bends or "dog-legs" in the riser therefore need to be avoided.

Where the riser's lower end connects to the wellhead assembly, the riser must be aligned vertically, to prevent the rotating drillstring from chafing and thereby damaging the blowout prevention equipment located immediately above the wellhead assembly. The well blowout prevention equipment must be maintained in an operable condition at all times.

To align the riser vertically at the wellhead assembly, when the riser is subjected to strong ocean currents, the vessel must be offset from, or moved away from, a location directly above the wellhead assembly. This offset position is necessary to compensate for the slight bend that develops in the entire riser assembly due to the ocean currents. For example, a riser 6000′ in length may require a vessel offset of 100 to 400 feet.

Due to this vessel offset, the upper elements of the riser tend to develop an angle of inclination from the vertical. But the upper end of the riser is typically secured vertically to the vessel, to allow vertical insertion and removal of the drillstring. The inclined position of the riser directly below the riser's vertical oriented vessel attachment point is permitted by the installation of a flexible coupling called a ball joint or flex joint, beneath the vessel attachment point. With the vessel offset 200 to 300 feet from the wellhead assembly in a water depth of 5000′ to 6000′, the inclination of the upper end of the riser may easily be 4° or more, causing this amount of misalignment between the inserted drilling equipment and the upper end of the riser.

But if the drillstring continuously rotates within this flexible coupling while the coupling is misaligned 4° end-to-end, chafing and subsequent damage will result, with possible separation of the drillstring and/or the riser. Any separation of either the drillstring or the riser will require expensive retrieval and repair operations with subsequent delays in field development.

An apparatus and method need be developed that reduces the angle of misalignment of the riser's upper section with the vessel's drilling equipment, to prevent failure of either the riser or the drillstring.

SUMMARY OF THE INVENTION

The present invention comprises a riser angle control apparatus, having a second flexible coupling operatively engaged with the riser approximately 100′ to 200′ below the first flexible coupling carried at the upper end of the riser, and also a tensioned member attached to the second flexible coupling. The original misalignment angle which existed solely at the first flexible coupling may now, by application of lateral force to the second flexible coupling, be "averaged" or "split" between the first and second flexible couplings.

A 4° angle of misalignment which existed solely at the first flexible coupling may now be reduced to a 2° angle of misalignment, with the other 2° of misalignment being absorbed by the second flexible coupling. The averaging of these angles between the two flexible couplings reduces "dog-legs" in the riser, thereby reducing the possibility of the rotating drillstring chafing the interior of the riser and/or being damaged by fatigue.

Specifically, the apparatus of the present invention comprises second flexible coupling means operatively engaged with a portion of said upper elements of said riser below said first flexible coupling means, flexible element prime mover means carried by said vessel, and at least one flexible element means having a first end and a second end, said first end operatively engaged with said second flexible coupling means, said second end operatively engaged with said flexible element prime mover means.

More specifically, the method of the present invention of reducing the angle of misalignment of a riser's upper elements relative to a floating vessel operatively engaged to the upper end of said riser, said riser having first flexible coupling means located adjacent the upper end of said riser, said vessel being provided with riser angle control apparatus including second flexible coupling means operatively engaged with said upper elements of said riser below said first coupling means, flexible element prime mover means carried by said vessel, and at least one flexible element means having a first end and a second end, said first end operatively engaged with said second flexible coupling means, said second end operatively engaged with said flexible element prime mover means, said method comprising orienting said flexible element means adjacent said second flexible coupling means opposite the direction of the normal angle of misalignment of said riser, actuating said flexible element prime mover means to tension said flexible element means, thereby distributing the angle of misalignment between the riser upper elements.

An object of the invention is to provide a method and apparatus to reduce the angle of misalignment from the vertical of a riser's upper elements relative to a vessel which supports the upper end of the riser, to prevent damage to the riser and a rotating drillstring carried within the riser.

A further object of the invention is to provide a riser angle control apparatus which is simple in design, rugged in construction, and economical to manufacture.

The various features of novelty which characterize the invention are pointed out with particularity in the claims next to and forming a part of this disclosure. For a better understanding of the invention, its operating advantages and specific object obtained by its uses, reference should be made to the accompanying drawing and descriptive matter in which there are illustrated preferred embodiments of the invention.

BRIEF DESCRIPTION OF THE DRAWING

The FIGURE is a schematic representation of a floating vessel conducting an underwater drilling operation in which a riser is shown connected between a floating vessel and a subsea wellhead assembly.

DESCRIPTION OF THE PREFERRED EMBODIMENT

As shown in the FIGURE, a vessel 10 is floating in a body of water 26 above a subsea wellhead assembly 29 located upon the ocean floor 20. A riser 42 comprised of riser upper elements 23 and riser lower elements 40 connects the vessel 10 with the subsea wellhead assembly 29. A drillstring 21 is carried within the riser 42, the drillstring 21 being manipulated by the drillstring and riser lift mechanism 34 and the rotary table 11, carried by the vessel 10, in order to drill formations located beneath the ocean floor 20 by means well known to the art. Riser tensioning equipment 14, 14A in the form of hydraulic pistons, cylinders, and cable sheave assemblies is secured to the upper elements of the riser 23. This riser tensioning equipment 14, 14A applies an upward lifting force to the upper elements of the riser 42 in order to prevent compressive structural failure of the lower elements of the riser 40.

Directional positioning thrusters 24, 24A and vessel propulsion means 22 assist in maintaining the vessel 10 above the wellhead assembly 29 while subjected to ocean currents 32 impacting the vessel 10 and riser 42 from a particular direction.

The riser upper elements 23 are shown connected at their upper end to vessel connection means 41, such as a bearing plate or truss support structure well known to the art. Located below and adjacent the vessel connection means 41 is the first flexible coupling means 36 incorporated into the riser upper elements 23, such as a "ball joint" or "flex joint" well known to the art which allows the riser 42 to deflect from a vertical orientation. The first flexible coupling means 36 has an opening defined through the central axis to allow the drillstring 21 to pass through.

The riser lower elements 40, similar to the riser upper elements 23, are shown connected at the lower end to blowout prevention equipment 39 carried by the wellhead assembly 29. The blowout prevention equipment 39 incorporates hydraulically driven rams and isolation valves (not shown) that, if necessary, isolate the subsea environment from downhole pressures and fluids. The proper operation of this equipment relies upon the mating of close tolerance surfaces and maintaining the integrity of the valve bodies. The rotating drillstring 21 is therefore maintained in a vertical orientation while passing through the blowout prevention equipment 39 to prevent damage to these mating surfaces and bodies, usually by offsetting the vessel 10 an offset distance 38 from the wellhead assembly 29. The direction of offset distance 38 is opposite the direction of the ocean current 32 direction, to compensate for the bend developed in the riser 42 from the ocean current 32.

The amount of offset distance 38 is primarily dependent upon the force imposed upon the riser 42 by the ocean current 32 and the overall length of the riser 42. The overall length of the riser 42 is approximately indicated by riser length dimension 37.

In the case of a water depth dimension 37 of 5000′ to 6000′, an offset distance 38 to 100′ to 400′ can be anticipated. This offset will cause a normal angle of misalignment 28 in the riser upper elements 23, which are shown in phantom positioned in the FIGURE before the activation of the apparatus of the present invention. This angle of misalignment 28 causes a corresponding angle to develope in the first flexible coupling means 36, causing chafing of the drillstring 21 with the interior of the riser upper elements 23.

In the preferred embodiment of the present invention, a second flexible coupling means 12 similar to the first flexible coupling means 36 is incorporated into the riser upper elements 23 a selective distance 44 below the first flexible coupling means 36. The actual spacing between couplings may be in 50 to 300-ft. range. This spacing can be determined by analysis of bending moments in the drill string and the contact forces between the riser bore and the drill string O.D. If the spacing is too large, the horizontal component of the force exerted on the flexible coupling means 12 by the flexible element means 25 will become small and render the device ineffective. Flexible element means 25 such as a chain or steel cable is operatively engaged with the second flexible coupling means 12 and the flexible means 25. Attachment means 30 by may take the form of chain or cable fastening devices well known to the art.

The other end of the flexible element means 25 is operatively engaged with flexible element prime mover means 13 such as a hydraulic piston and cylinder assembly well known to the art. The prime mover means 13 may be carried at any convenient location by the vessel 10, such as upon the vessel deck 43. A control panel 18 and control lines 19 supply pressurized hydraulic fluid to the prime mover means 13 to selectively move the flexible element means 25 and consequently the second flexible coupling means 12.

The flexible element means 25 are slideably engaged with rotatable element means such as pulleys 15 and 16 in the preferred embodiment. Pulleys 15 and 16 assist in routing the flexible element means 25 from the prime mover means 13 to the second flexible coupling means 12. The connection operation pulley 17 may be utilized during installation or removal of the second flexible coupling means 12 through the hull opening 33 in order to prevent abrasion of the flexible element means 25 attached to the coupling 22 due to contact with the vessel 10 bottom. Of course, the proper orientation and alignment of pulleys 15 and 16 depends upon the positioning of the flexible element prime mover means 13 in relation to the second flexible coupling means 12 location which is determined as discussed earlier.

In operation, when the vessel 10 is offset from above the wellhead assembly 29 to compensate for ocean currents 32, a normal angle of misalignment 28 will be ascertainable at the upper end of the riser 42. When the angle 28 exceeds, for example, approximately 2°, continued rotation of the drillstring 21 will damage the interior of the riser upper elements 23. The present embodiment of the invention must be actuated to prevent this damage. The flexible element means 25 adjacent the second flexible coupling means 12 is oriented opposite the direction of the normal angle of misalignment 28 of the riser upper elements 23. If the ocean current 32 impacts the riser's 42 northern face, the riser 42 will bend in a southerly direction. To compensate for this southern misalignment, the flexible element means 25 are orientated to apply a tensile force to the northern face of the riser 42. The flexible element prime mover means 13 are then actuated to tension the flexible element means 25, thereby causing a reduction of the normal angle of misalignment 28 of the riser upper elements 23.

The resultant adjusted angle of misalignment 27 of, for example, approximately 2° or less will prevent internal damage to the riser upper elements 23 and drillstring 21. In this fashion the original angle 28 of approximately 4° may be averaged between the first flexible coupling means 36 and the second flexible coupling means 12. Of course, if both flexible couplings 36, 12 are not sufficient to reduce the adjusted angle of misalignment 27 for each section of riser 42 below 2°, in an alternative embodiment additional flexible couplings with associated tensioning equipment (not shown) may be added along the length of the riser 42.

In the present embodiment, since the flexible element means 25 are actuated from a bow mounted prime mover means 13, the vessel 10 may be turned to face into the direction of the ocean current 32 to properly align the flexible element means 25 in the desired direction.

The angles of misalignment 28 and 27, offset distance 38, and riser length 37, all being geometrically related to each other, will vary according to the particular geometry of each vessel 10, riser 42, and wellhead assembly 29 encountered in different water depths 37.

In an alternative embodiment, the flexible element prime mover means 13 may be moveably mounted about the vessel deck 43 of the vessel 10. In this fashion, the vessel 10 may stay orientated in its original position and the flexible element means 25 moved relative to the riser upper elements 23. In any event, tensioning the flexible element means 25 after proper orientation will cause a decrease in the normal angle of misalignment 28.

Many other variations and modifications may be made in the apparatus and techniques hereinbefore described by those having experience in this technology, without departing from the concept of the present invention. Accordingly, it should be clearly understood that the apparatus and methods depicted in the accompanying drawings and referred to in the foregoing description are illustrative only and are not intended as limitations on the scope of the invention.

I claim as my invention:

1. For use with a floating vessel having well drilling equipment, including an elongated riser having upper elements connected to said floating vessel by vessel connection means, and first flexible coupling means located adjacent said vessel connection means, said riser extending down from said vessel connection means to a point adjacent the ocean floor, the improvement comprising riser angle control apparatus comprising:

second flexible coupling means operatively engaged with a portion of said upper elements of said riser below said first flexible coupling means, flexible element prime mover means carried by said vessel, and at least one flexible element means having a first end and a second end, said first end operatively engaged with said second flexible coupling means, said second end operatively engaged with said flexible element prime mover means.

2. The apparatus of claim 1 wherein said second flexible coupling means further includes attachment means operatively engaged between said second flexible coupling means and said flexible element means.

3. The apparatus of claim 1 wherein said flexible element prime mover means is carried by a deck of said vessel, said prime mover means being operatively engaged to said flexible element means for selectively moving said flexible element means.

4. The apparatus of claim 1 wherein said flexible element means are slideably engaged with rotatable element means carried by said vessel located between said flexible element prime mover means and said second flexible coupling means.

5. The apparatus of claim 1 wherein the flexible element means located adjacent said second flexible coupling means is oriented opposite a direction of misalignment of said upper elements of said riser.

6. The apparatus of claim 1 wherein said flexible element means is comprised of steel cable.

7. A method of reducing the angle of misalignment of a riser's upper elements relative to a floating vessel operatively engaged to the upper end of said riser, said riser having first flexible coupling means located adjacent the upper end of said riser, said vessel being provided with a riser angle control apparatus including second flexible coupling means operatively engaged with said upper elements of said riser below said first flexible coupling means, flexible element prime mover means carried by said vessel, and at least one flexible element means having a first end and a second end, said first end operatively engaged with said second flexible coupling means, said second end operatively engaged with said flexible element prime mover means, said method comprising:

orienting said flexible element means adjacent said second flexible coupling means opposite the direction of the normal angle of misalignment of said riser, actuating said flexible element prime mover means to tension said flexible element means, thereby distributing the angle of misalignment between the riser upper elements.

8. The method of claim 7, wherein the step of orienting said flexible element means opposite the direction of misalignment of said riser includes the step of turning said vessel about said riser to align the flexible element means in the desired direction.

* * * * *